US006692262B1

(12) United States Patent
Loveless

(10) Patent No.: US 6,692,262 B1
(45) Date of Patent: Feb. 17, 2004

(54) CONNECTOR ASSEMBLY FOR COUPLING A PLURALITY OF COAXIAL CABLES TO A SUBSTRATE WHILE MAINTAINING HIGH SIGNAL THROUGHPUT AND PROVIDING LONG-TERM SERVICEABILITY

(75) Inventor: Richard Whitcomb Loveless, Burlington, VT (US)

(73) Assignee: Huber & Suhner, Inc., Essex Jct., VT (US)

( * ) Notice: Subject to any disclaimer, the term of this patent is extended or adjusted under 35 U.S.C. 154(b) by 0 days.

(21) Appl. No.: 10/216,880

(22) Filed: Aug. 12, 2002

(51) Int. Cl.[7] ..... H01R 9/05
(52) U.S. Cl. ..... 439/63; 439/581
(58) Field of Search ..... 439/63, 581

(56) References Cited

U.S. PATENT DOCUMENTS

| | | | | |
|---|---|---|---|---|
| 4,995,815 A | | 2/1991 | Buchanan et al. | |
| 5,120,258 A | | 6/1992 | Carlton | |
| 5,194,020 A | | 3/1993 | Voltz | |
| 5,478,258 A | | 12/1995 | Wang | |
| 5,720,620 A | * | 2/1998 | Nobe et al. | 439/63 |
| 5,730,621 A | * | 3/1998 | Wang | 439/541.5 |
| 5,851,121 A | * | 12/1998 | Thenaisie et al. | 439/63 |
| 6,007,347 A | | 12/1999 | Keldsen et al. | |
| 6,149,461 A | * | 11/2000 | Emery | 439/578 |
| RE37,368 E | | 9/2001 | Huppenthal et al. | |
| 6,312,287 B1 | * | 11/2001 | Harting et al. | 439/581 |
| 6,386,913 B1 | | 5/2002 | Mohammad et al. | |
| 6,468,089 B1 | * | 10/2002 | Hubbard et al. | 439/63 |
| 6,488,512 B2 | * | 12/2002 | Gonzales | 439/63 |

* cited by examiner

*Primary Examiner*—Gary Paumen
(74) *Attorney, Agent, or Firm*—Burr & Brown

(57) ABSTRACT

A connector assembly for coupling a plurality of coaxial cables to a substrate, including a housing adapted to be removably attached to a first area of a substrate, the housing having a first wall with an array of holes formed therethrough, and connector bodies releasably retained within the housing in substantial alignment with the array of holes. Each connector body includes a bore extending therethrough, an insulator fixed within the bore, and a center contact releasably positioned within a central bore formed in the insulator. A coaxial cable segment is operatively connected to each of the connector bodies, and each coaxial cable segment includes a center conductor fixed to the center contact and an outer shielding conductor fixed to the connector body. Each of the coaxial cable segments extends outwardly from the housing and has a distal end adapted to be connected to another area of the circuit board.

40 Claims, 8 Drawing Sheets

CONNECTOR ASSEMBLY FOR COUPLING A PLURALITY OF COAXIAL CABLES TO A SUBSTRATE WHILE MAINTAINING HIGH SIGNAL THROUGHPUT AND PROVIDING LONG-TERM SERVICEABILITY

FIELD OF THE INVENTION

The present invention relates to a connector assembly for coupling a plurality of coaxial cables to a substrate, such as a circuit board, and in particular a connector assembly that provides high RF signal throughput with reduced losses and allows the center contacts of the assembly to be easily serviced or replaced.

BACKGROUND OF THE INVENTION

The use of RF signals to transfer data among various electronic components has grown in necessity as the complexity of such electronic components has increased. For example, test equipment that is used to analyze semiconductor chips requires very sophisticated data transmission techniques that operate at very high frequencies.

In order to ensure that the high frequency signals are delivered from one piece of equipment to another (e.g., from a test head for a semiconductor chip to a sophisticated piece of analysis equipment), it is common to use flexible or semi-rigid coaxial cable consisting of a center conductor, a dielectric insulator, and an outer shielding conductor. These types of cable are widely available, and can carry signals exceeding 40 GHz.

Since the coaxial cables are repeatedly mated and demated with the associated equipment, it is necessary to use coaxial cable connectors to terminate the ends of the cables, and the connectors must be able to pass the high frequency signals with minimal loss. One example of such a coaxial cable connector is an SSMA type connector, which can easily pass a signal up to 40 GHz.

While the coaxial cable and connectors can transmit high frequency signals, significant losses occur at the juncture between the cable connector and the printed circuit board that forms part of the functional piece of equipment. For example, one type of cable connector includes a connector body that transmits the RF signal in a direction 90 degrees offset from the transmission direction within the coaxial cable. This type of connector is designed to mate with a port that is hard soldered to the circuit board, and the conductor pin in the port also mates with conductive traces on the circuit board at yet another right-angle transition. Accordingly, when using this type of connector, the RF signal must propagate through two right-angle transition points, which results in significant loss to the point where the signal actually delivered to the conductive trace on the circuit board usually cannot exceed 10 GHz.

Another typical cable conductor used in these applications is mounted on the edge of the circuit board, as shown in FIG. 12, in an attempt to avoid the right-angle transitions discussed above (this type of multiple channel connector also allows a plurality of connections with a single coupling operation). This type of "edge-launch" connector requires the use of relatively long conductive traces on the circuit board itself to carry the signal to the functional device mounted on the circuit board at some remote location. It is well known, however, that it is very difficult to maintain high RF signals in circuit board conductive traces without experiencing significant losses. RF transmission lines require a delicate balance between the structure and position of the individual copper traces on the circuit board, the spacing therebetween, the ground planes used in the circuit board, and the dielectric materials used to make up the circuit board itself. Standard dielectric materials such as fiber glass materials usually are incapable of maintaining high RF signals within the transmission lines formed on the circuit board. While the dielectric material of the circuit board could be replaced with a higher quality material, this solution unacceptably increases the overall expense of the circuit board.

In order to overcome the inherent shortcomings of transmission lines formed on standard printed circuit boards, it has been a practice to terminate the coaxial cable at a position as close as possible to the intended functional device mounted on the circuit board. This minimizes the length of the conductive trace that must actually be formed on the circuit board. Coaxial connectors that are used for this type of termination are designed to mate with a port extending upwardly from the circuit board. Again, however, there is usually at least one angled transition involved, which, as explained above, results in significant signal loss.

Another problem with attaching the coaxial cable to a position closely adjacent to the intended functional device arises from the fact that the coaxial cable will be subjected to hundreds of mating/demating cycles with the port on the circuit board. Consequently, there is the possibility that the technician performing the connection may damage sensitive electronic components that are positioned adjacent to the port. Still further, when the coaxial cable is semi-rigid, torquing forces imposed on the port by the relatively long coaxial cable can damage the port, the underlying connection to the circuit board, or the circuit board itself, all of which could result in significant repair cost.

Yet another problem with locating the port immediately adjacent to the end device occurs when multiple cables are necessary for communicating with multiple devices on a single circuit board. That is, since each port will be located at a different location on the circuit board, it is impossible to use any type of multiple channel connector (such as shown in FIG. 12), since such a connector would require the ports to be arranged adjacent to one another on the circuit board. Accordingly, whenever a technician has to perform a connection, each of the plurality of coaxial cables has to be handled individually.

Having a plurality of semi-rigid cables connected at a variety of locations on a circuit board gives rise to several additional problems. For example, the more cables a technician has to handle, the more likely it is that there will be a mistake in matching up the correct cable with the correct port. Further, the presence of numerous cables extending in a variety of directions from the circuit board makes it more difficult to access and house the circuit board, especially in test head type applications.

U.S. Pat. No. 4,995,815 attempts to address the problem of remote cable termination at a variety of locations on a circuit board, by providing a coupler that can be mounted directly on the circuit board for electrical connection to a conductive trace formed at some remote location on the circuit board. The coupler disclosed in U.S. '815 (shown in FIG. 13) also orients the coaxial cable termination end in line with a shorter length of coaxial cable in an attempt to provide a smooth transition onto the circuit board. The above-discussed problems still exist, however, in that the coupler must be positioned at a variety of different locations on the circuit board.

U.S. Pat. No. 6,007,347 also attempts to provide an improved connector assembly for a circuit board. FIG. 14 shows a plurality of coaxial cables 240 extending from a connector frame 140 mounted to the edge of a circuit board 120. The terminal end of each coaxial cable 240 is electrically connected within a complicated "slot-and-pad connection element" 320 formed at specific locations on the circuit board. While this arrangement may be intended to reduce signal loss between the connector at the end of the exterior coaxial cable and the beginning of the conductive trace on the circuit board, it still does not address the inherent problem of signal losses occurring in the conductive traces on the circuit board itself. Specifically, the '347 patent shows the slot-and-pad connection elements all arranged near the edge of the circuit board, and, consequently, significant signal losses will be encountered within the conductive traces that actually supply the signals to the functional devices that are located at interior, relatively remote portions of the circuit board. In addition, due to the complicated nature of the slot-and-pad connection elements 320, the cost of manufacturing the circuit board is somewhat prohibitive.

In addition to all the above, none of the prior art connector assemblies provides an easy and efficient way to service the assemblies after a predetermined number of mating/demating cycles. That is, in order to maintain high RF throughput through the connector assemblies all the way to the functional devices on the circuit board, the center contacts in the connector assemblies must be periodically replaced. While this may be relatively easy when addressing individual male ports, it becomes a significant problem when dealing with multiple channel connectors, such as shown in FIG. 12. In the event that the center contact of any one connector of the multiple channel connector becomes worn or damaged, and requires replacing, it has been standard practice to simply replace the entire multiple channel connector unit. It would be much more cost effective if the individual center contacts (which are typically the first part to deteriorate) of each conductor could be easily replaced on an as-needed basis.

SUMMARY OF THE INVENTION

It is an object of the present invention to overcome the drawbacks of the prior art as discussed above. In accordance with one embodiment of the present invention, a connector assembly for coupling a plurality of coaxial cables to a substrate (e.g., a circuit board) is provided, which includes a housing adapted to be removably attached to a first area of a substrate, the housing having a first wall with an array of holes formed therethrough, and a plurality of connector bodies releasably retained within the housing in substantial alignment with the array of holes. Each connector body includes a bore extending therethrough, an insulator fixed within the bore, and a center contact releasably positioned within a central bore formed in the insulator. A coaxial cable segment is operatively connected to each of the connector bodies, and each coaxial cable segment includes a center conductor fixed to the center contact and an outer shielding conductor fixed to the connector body. Each of the coaxial cable segments extends outwardly from the housing and has a distal end adapted to be connected to another area of the circuit board.

The connector assembly in accordance with the first embodiment of the present invention overcomes many of the drawbacks associated with the prior art. For example, since the connector assembly includes a plurality of coaxial cable segments, the distal end of each coaxial cable segment can be terminated immediately adjacent to any number of functional devices, thus solving the problem of signal losses in the conductive traces on the circuit board.

In addition, since the housing is removably attached to the circuit board, and since the connector bodies are releasably retained within the housing, the connector bodies can be easily accessed for repair and/or replacement with minimal desoldering effort. Moreover, since the center contact is releasably positioned within the central bore of the insulator fixed within the connector body, the center contact can be separated from the connector body with only a single desoldering step. The releasable nature by which the components of the connector assembly are secured to the substrate facilitates long term serviceability of the connector assembly, especially the center contacts, which are typically the first part to deteriorate after repeated mating/demating cycles.

It is preferred that each of the connector bodies has a first end positioned proximate the first wall of the housing and an opposed second end, and is substantially cylindrical having a sidewall defining the bore thereof, and that each of the connector bodies includes a slot extending through the sidewall proximate the second end thereof so that the coaxial cable segment can extend through the slot. This configuration insures a smooth transition for the coaxial cable segment exiting the connector body to help avoid any signal loss in this region. It is also preferred that a plurality of slots are formed through a sidewall of the housing in substantial alignment with the slots in the connector bodies so as to enable the coaxial cables to make a smooth exit from the housing.

To help releasably retain the connector bodies within the housing, it is preferred that each of the connector bodies includes a retaining member proximate the second end thereof, which engages a corresponding portion formed in the housing. More preferably, the retaining member is a radially extending flange and the portion of the housing includes an annular recess that is substantially complementary in shape to and receives the flange. This arrangement allows the connector bodies to be freely positioned on the surface of a circuit board, captured as a group within the housing, and securely, yet releasably, retained within the housing.

In accordance with another embodiment of the present invention, the connector assembly also includes a port fixed to the distal end of each coaxial cable segment to mechanically and electrically terminate the center conductor and the shielding conductor of the coaxial cable segment to the substrate. Preferably, the port has a first section having a first diameter positioned proximate a first end thereof, and a second section having a second diameter positioned proximate a second end thereof, and the shielding conductor of each coaxial cable segment is fixed to the first section and the center conductor extends through the second section.

In accordance with yet another embodiment of the present invention, a circuit board apparatus is provided that includes a circuit board having at least one functional device positioned on a first area thereof and a connector assembly positioned on a second area of the circuit board. The connector assembly includes a housing removably attached to a second area of the circuit board distal from the first area, and the housing includes a first wall with an array of holes formed therethrough, and a plurality of connector bodies releasably retained within the housing in substantial alignment with the array of holes. Each connector body includes a bore extending therethrough, an insulator fixed within the bore, and a center contact releasably positioned within a central bore formed in the insulator. A coaxial cable segment is operatively connected to each of the connector bodies, and each coaxial cable segment includes a center conductor fixed to the center contact and an outer shielding conductor fixed to the connector body. Each of the coaxial cable segments extends outwardly from the housing and has a distal end, and a port is fixed to the distal end of each coaxial cable segment to mechanically and electrically terminate the center conductor and the shielding conductor to the circuit board.

In accordance with still another embodiment of the present invention, a circuit board apparatus is provided that includes a circuit board having at least one functional device positioned on a first area thereof and a connector removably fastened on a second area thereof. The connector includes a substantially cylindrical connector body having a first end, an opposed second end, a sidewall defining a bore extending from the first end to the second end, and a slot extending through the sidewall proximate the second end. An insulator is fixed within the bore and a center contact is releasably positioned within a central bore formed in the insulator. A coaxial cable segment is operatively connected to the connector body and includes a center conductor fixed to the center contact and an outer shielding conductor fixed to the connector body. The coaxial cable segment extends outwardly from the connector body through the slot. A port is fixed to a distal end of the coaxial cable segment to mechanically and electrically terminate the center conductor and the shielding conductor to the circuit board.

DETAILED DESCRIPTION OF THE INVENTION

Figure 1:
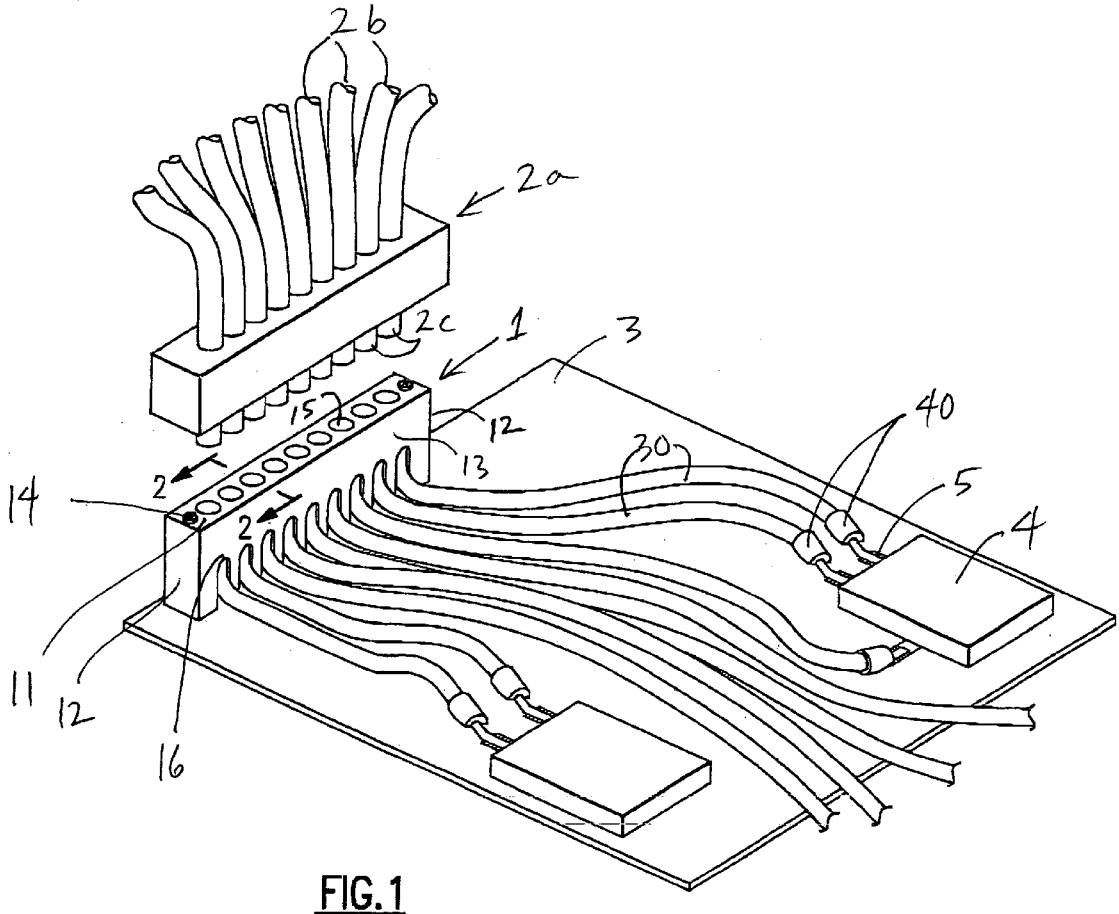
FIG. 1 is a perspective view of a circuit board including a connector assembly in accordance with an embodiment of the present invention.

FIG. 1 shows a circuit board including a connector assembly in accordance with one embodiment of the present invention. The connector assembly 1 is adapted to mate with a multiple channel connector unit 2*a* that terminates a plurality of coaxial cables 2*b* in an array of connectors 2*c*. The connector assembly 1 is mounted to a printed circuit board 3, at a first area of the circuit board, preferably proximate an edge surface to facilitate mating and demating. The connector assembly 1 includes a plurality of connector bodies 20 (FIG. 2) positioned in an array in alignment with connectors 2*c* provided on multiple channel connector unit 2*a*. It is preferred that the entirety of each connector body is positioned within the housing to establish the necessary alignment for each RF interface.

A plurality of coaxial cable segments 30 extend outwardly from the connector assembly 1, and each is terminated by a port 40. The port 40 provides mechanical and electrical contact between the coaxial cable segment 30 and a remote location on the circuit board 3 proximate a functional device 4. The center conductor of coaxial cable segment 30 is soldered to a transmission line 5 formed on circuit board 3 to provide electrical communication between coaxial cable segment 30 and functional device 4. FIG. 1 shows that the coaxial cable segments 30 can have lengths that differ from one another, so as to access functional devices 4 positioned at different distances from the connector assembly 1.

The connector assembly 1 includes a substantially rectangular housing 10 defined by a first (upper) wall 11, opposed end walls 12, and opposed second (side) walls 13. The housing is removably attached to circuit board 3 by a suitable securing mechanism, such as bolts 14, or the like. The first wall 11 of housing 10 includes a plurality of holes 15 that provide access to connector bodies 20. While the connector bodies 20 are shown arranged in a single line in FIG. 1, any array configuration could be used provided coaxial cable segments 30 can easily exit housing 10.

Figure 2:
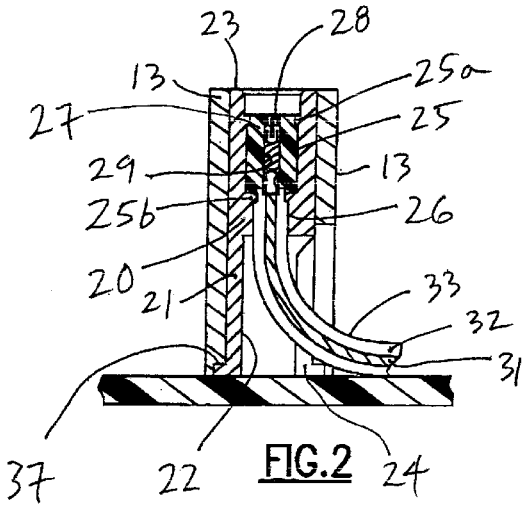
FIG. 2 is a cross-sectional view taken through line 2—2 of FIG. 1.

FIG. 2 is a cross-sectional view taken along line 2—2 of the connector assembly 1 shown in FIG. 1. FIG. 2 shows that connector body 20 is generally cylindrical in shape and includes a sidewall 21 defining a central bore 22 passing therethrough from a first end 23 of the connector body to an opposed, second end 24 thereof. The first end 23 of connector body 20 is positioned proximate the first (upper) wall 11 of housing 10.

The central bore 22 of connector body 20 includes a first section 25 positioned proximate first end 23 and a second section 26 positioned below first section 25 in the direction of second end 24. The first section 25 has a first diameter and the second section 26 has a second diameter, and the first diameter is slightly larger than the second diameter.

An insulator 27 is press fit within first section 25 of connector body 20. Preferably, first section 25 includes stepped portions 25*a* and 25*b* that fix insulator 27 in place within first section 25. Since insulator 27 is usually formed from a resilient material, such as PTFE, it can be contracted in size and inserted in first section 25.

A center contact 28 is releasably positioned within a central bore 29 formed through insulator 27. That is, the outer diameter of center contact 28 is smaller than the inner diameter of central bore 29, so that center contact 28 is releasably positioned within central bore 29. The center contact has a first end that is adapted to grip the male pin of the connectors 2*c* of multiple channel connector body 2*a*. Center contact 28 also includes an opposed, second end having a recess therein.

Coaxial cable segment 30 includes a center conductor 31, a dielectric layer 32, and a shielding conductor 33. The terminal end of center conductor 31 is soldered within the recess in the second end of center contact 28. The terminal end of shielding conductor 33 is soldered within second section 26 of connector body 20. In this manner, the connector body 20 is in electrical communication with the shielding conductor 33, while the center contact 28 is in electrical communication with center conductor 31. Insulation layer 32 maintains a controlled impedance environment between center conductor 31 and shielding conductor 33, while insulator 27 maintains a controlled impedance environment between connector housing 20 and center contact 28.

A slot 35 (FIG. 3) is formed through sidewall 21 of connector body 20 to allow coaxial cable segment 30 to exit connector body 20 in a smooth, transitional fashion. Again, high RF signals do not propagate well through transmission lines that contain any abrupt turns. By providing slot 35 in sidewall 21 of connector body 20, coaxial cable segment 30 can make a smooth transition out of connector body 20 from the region of insulator 27.

A plurality of slots 16 are also formed in sidewall 13 of housing 10 in substantial alignment with the slots 35 formed through the sidewalls 21 of each connector body 20, so as to allow the coaxial cable segments 30 to exit housing 10.

Figure 3:
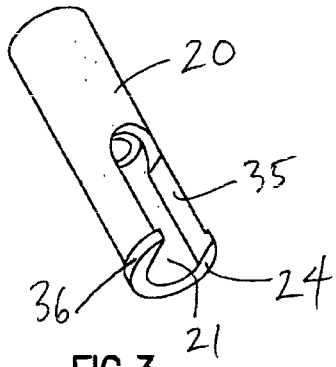
FIG. 3 is a perspective view of connector body 20 shown in FIG. 2.

FIG. 3 is a perspective view of the connector body 20 shown in FIG. 2. FIG. 3 shows that connector body 20 preferably includes a retaining member 36 positioned at second end 24 thereof. Preferably, the retaining member 36 is in the shape of a radially extending flange. The retaining member 36 is received within a complementarily shaped annular recess 37 formed in the bottom of housing 10 (see FIG. 2). In this manner, a plurality of connector bodies 20 can be freely arranged on circuit board 3 and then held in place by connecting housing 10 using a securing mechanism, such as bolts 14, to removably attach housing member 10 to circuit board 3. That is, the interaction between retaining member 36 and annular recess 37 causes the connector bodies 20 to be releasably retained within housing 10 in pressed engagement against the upper surface of circuit board 3.

Figure 4:
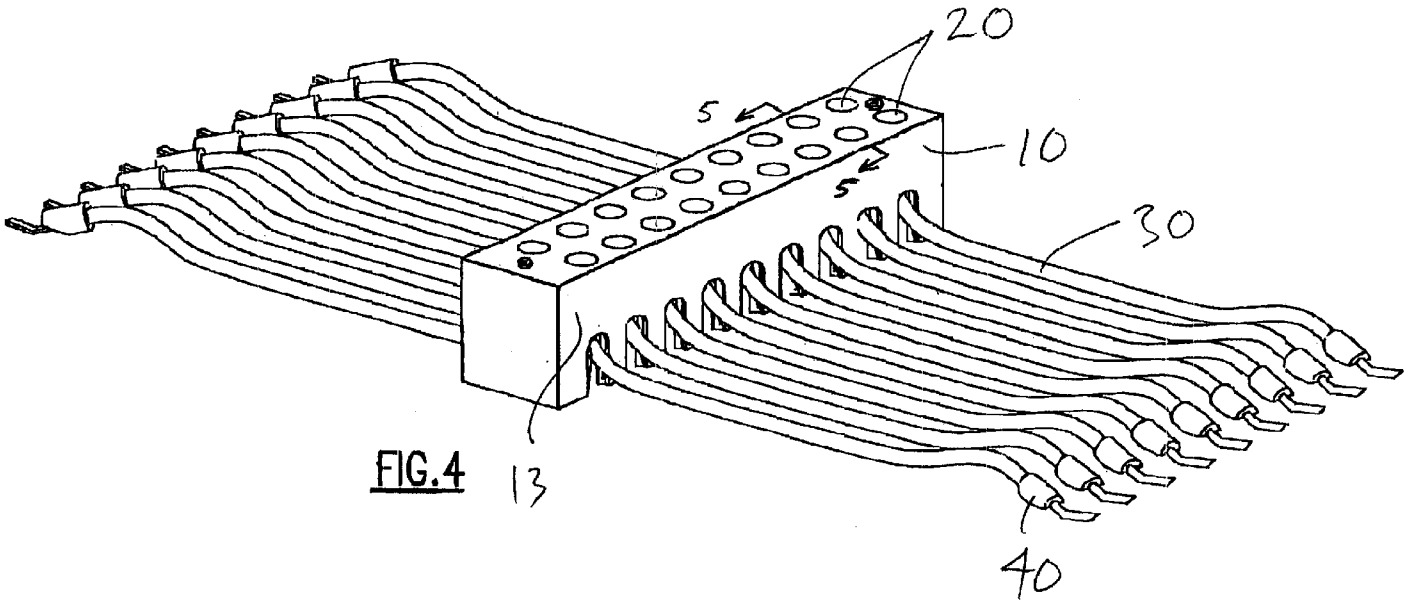
FIG. 4 is a perspective view of a connector assembly in accordance with another embodiment of the present invention.

FIG. 4 shows another embodiment of a connector assembly in accordance with the present invention. The connector assembly of FIG. 4 is similar in structure to that shown in FIG. 1, except that two rows of connector bodies 20 are formed in housing 10. As such, coaxial cable segments 30 can extend from both sidewalls 13 of housing 10.

Figure 5:
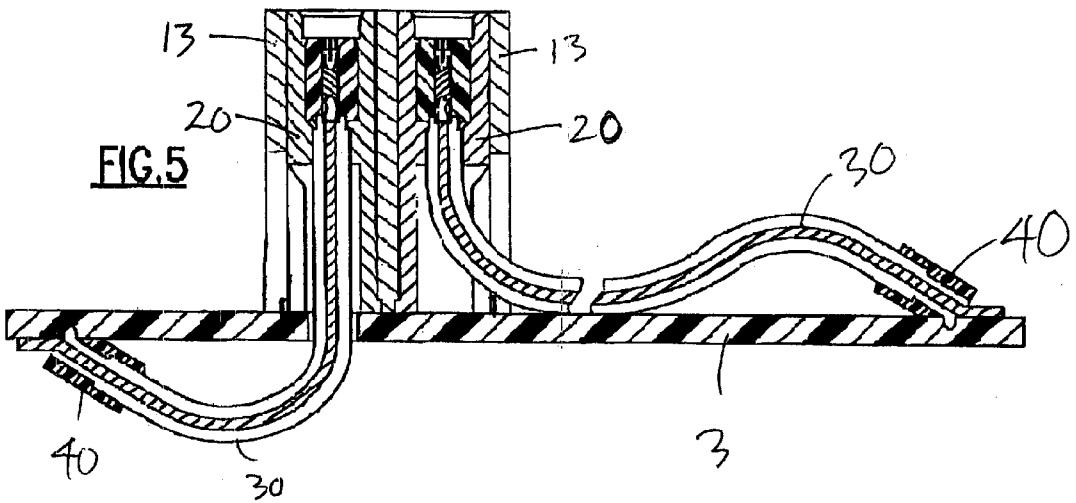
FIG. 5 is a cross-sectional view taken through line 5—5 of FIG. 4.

FIG. 5 is a cross-sectional view taken through line 5—5 of FIG. 4, except that the left-hand coaxial cable segment 30 is shown passing through circuit board 3 to access the reverse side thereof. FIG. 5 shows that the structure of the connector bodies 20 is the same as that shown in FIG. 2 (the connector bodies 20 are arranged in a back-to-back manner in FIG. 5).

The connector assemblies shown in FIGS. 1–5 enable high throughput of RF signals therethrough without experiencing the significant losses associated with prior art structures. Specifically, by using coaxial cable segments 30, the RF signals can be preserved all the way to termination port 40, which is positioned immediately adjacent to the functional device 4. While a transmission line 5 is still necessary to make the ultimate connection to device 4, it is of minimal length, and thus results in minimal loss of the RF signal.

Figure 6:
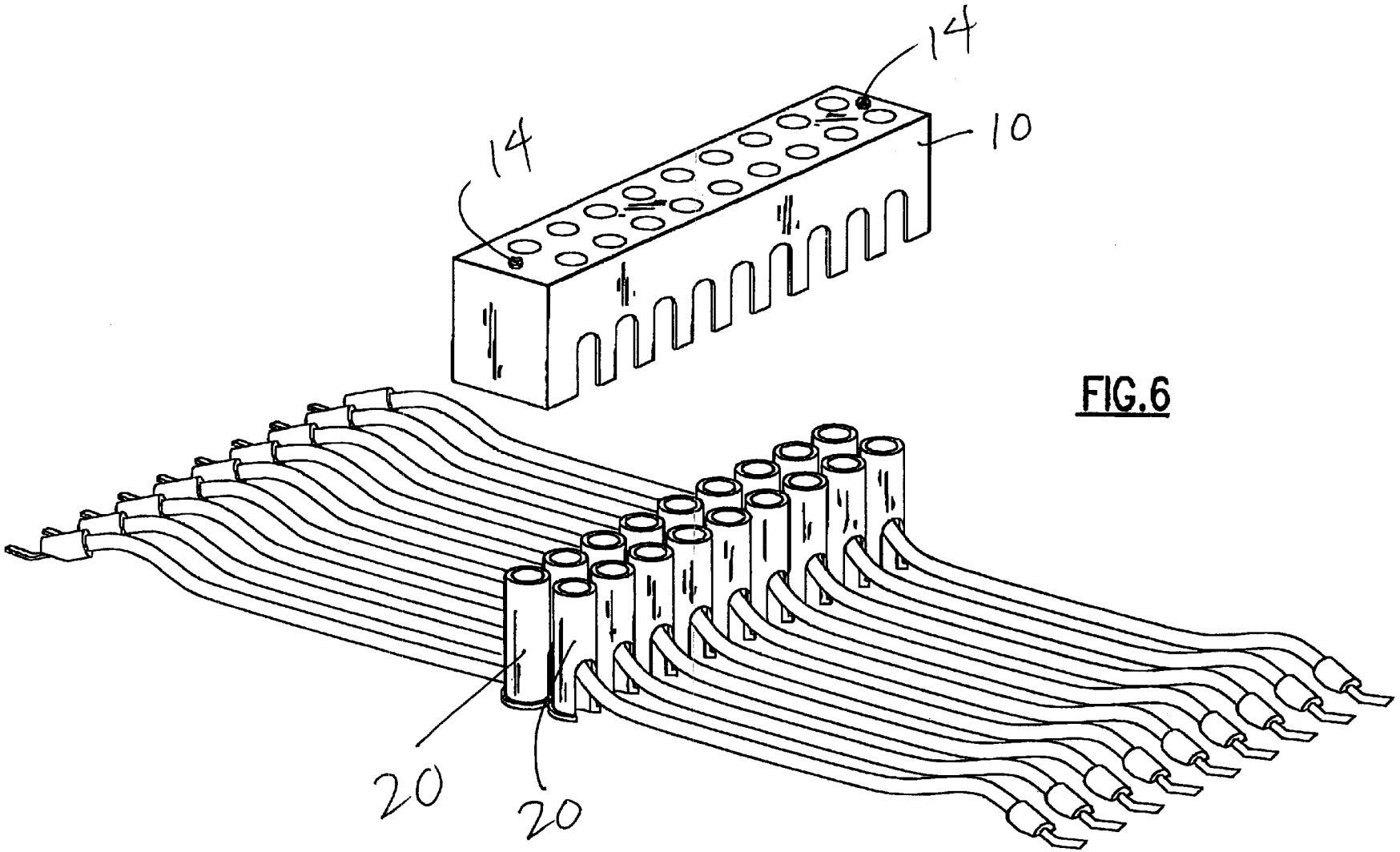
FIG. 6 is a perspective view of the connector assembly shown in FIG. 4 with housing 10 removed.
Figure 7:
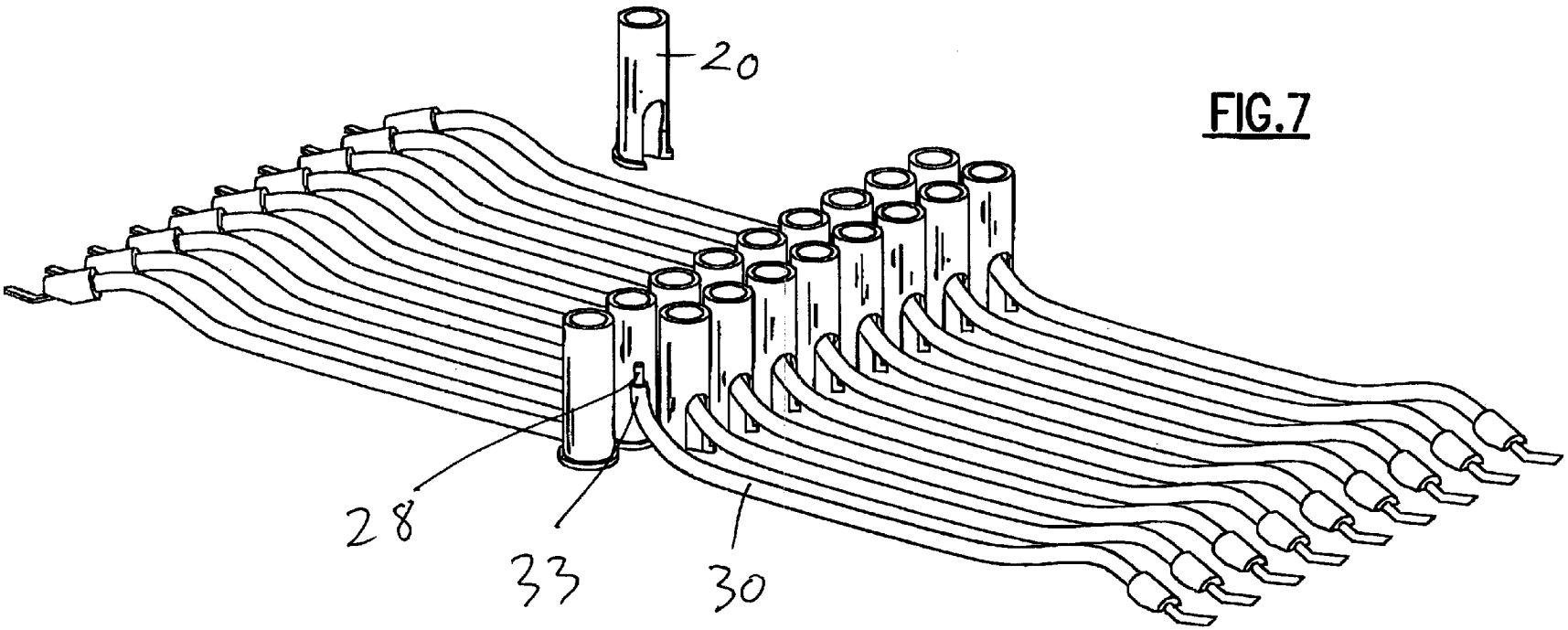
FIG. 7 is a perspective view of the connector assembly shown in FIG. 4 with one of the connector bodies 20 removed.

The releasable manner in which the components of the connector assembly are attached to the circuit board also provides long-term serviceability, especially with respect to the center contact 28. In applications that will experience repeated (e.g., more than 500) mating/demating cycles, it is necessary to replace the center contact 28 periodically in order to maintain high RF throughput through the connector assembly. FIG. 6 shows that, when any given center contact 28 needs replacement, the housing 10 can be easily removed from circuit board 3 by removing bolts 14, thereby exposing each of the connector bodies 20. FIG. 7 shows that a simple desoldering operation disconnects the housing member 20 from the shielding conductor 33 of any given coaxial cable segment 30. Since the center contact 28 is releasably positioned within the central bore 29 of insulator 27, the center contact 28 simply slides out of the connector body 20 after the desoldering step. The center contact 28 can then be easily desoldered from the center conductor 31 of the coaxial cable segment 30 and replaced with a fresh center contact 28. The connector body 20 can then be resoldered to the terminal end of shielding conductor 33, and the housing 10 replaced to finish the remedial/maintenance operation.

The structures of the connector assemblies shown in FIGS. 1–5 make it extremely easy to provide long-term service for the connector assembly. That is, whenever a given center contact 28 becomes damaged or worn, that particular contact can be replaced without having to replace the entire connector assembly. Additionally, the connector assembly could be serviced periodically to replace all of the center contacts 28 to ensure that high RF throughput is always maintained through the assembly.

Figure 8:
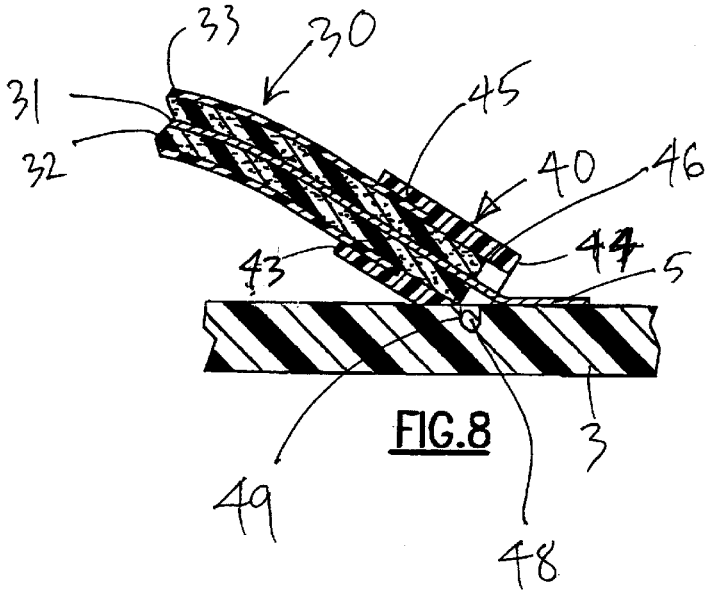
FIG. 8 is a cross-sectional view showing the structure of port 40.

FIG. 8 is a cross-sectional view of the port 40 that is used to terminate the end of each coaxial cable segment 30. The port 40 includes a generally cylindrical body 41 having a central bore 42 (FIG. 9) extending from a first end 43 of body 41 to a second end 44 thereof. The central bore 42 defines a first section 45 having a first diameter, and a second section 46 having a second diameter smaller than the first diameter. The first section 45 is positioned proximate the first end 43 of body 41, and the second section 46 is positioned proximate the second end 44 of body 41.

FIG. 8 shows that shielding conductor 33 is fixed to first section 45, preferably by solder. Insulating layer 32 extends into second section 46, and center conductor 31 exits central bore 42 through the second end 44 of port 40. The terminal end of center conductor 31 is smoothly soldered to conductive trace 5 formed on circuit board 3. This smooth transition ensures that minimal losses will occur in the RF signal transmitted from center conductor 31 to conductive trace 5.

Figure 9:
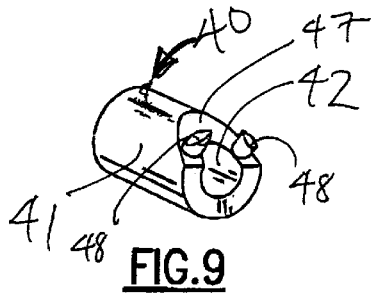
FIG. 9 is a bottom perspective view of port 40.

FIG. 9 is a perspective view of port 40 and shows that second end 44 includes an inclined portion 47 that is adapted to engage the surface of circuit board 3. By providing inclined portion 47, the central bore of port 40 can be inclined with respect to the upper surface of circuit board 3 and ensure a smooth transition between center conductor 31 and conductive trace 5.

FIG. 9 also shows that positioning members 48 extend from inclined portion 47 to allow the port 40 to be accurately positioned on circuit board 3. Specifically, positioning members 48 are received within recesses 49 formed in the upper surface of circuit board 3, and help align the port, and thus the terminal end of coaxial cable 30, with the conductive trace printed on circuit board 3. Recesses can be formed anywhere on circuit board 3 by a simple drilling operation. Although not shown in the drawings, inclined portion 47 of port 40 would be soldered to a ground contact on circuit board 3 to provide electrical communication between ground and shielding conductor 33 of coaxial cable 30.

Figure 10:
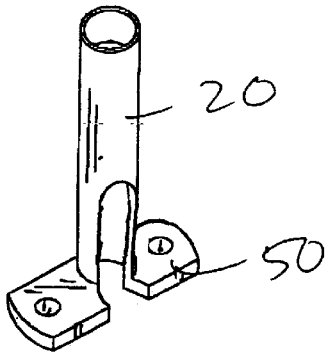
FIG. 10 is a perspective view of a connector body in accordance with another embodiment of the present invention.
Figure 12:
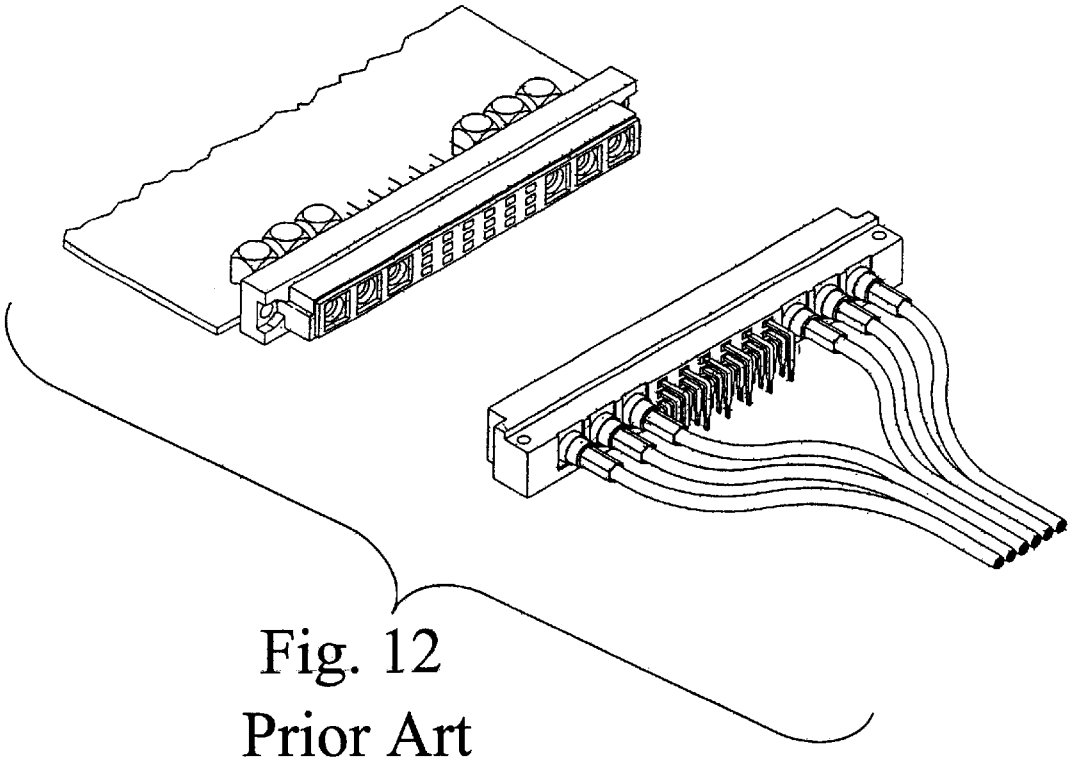
Fig. 12 Prior Art
FIG. 12 is a perspective view of a conventional edge-launch multiple channel connector unit.
Figure 13:
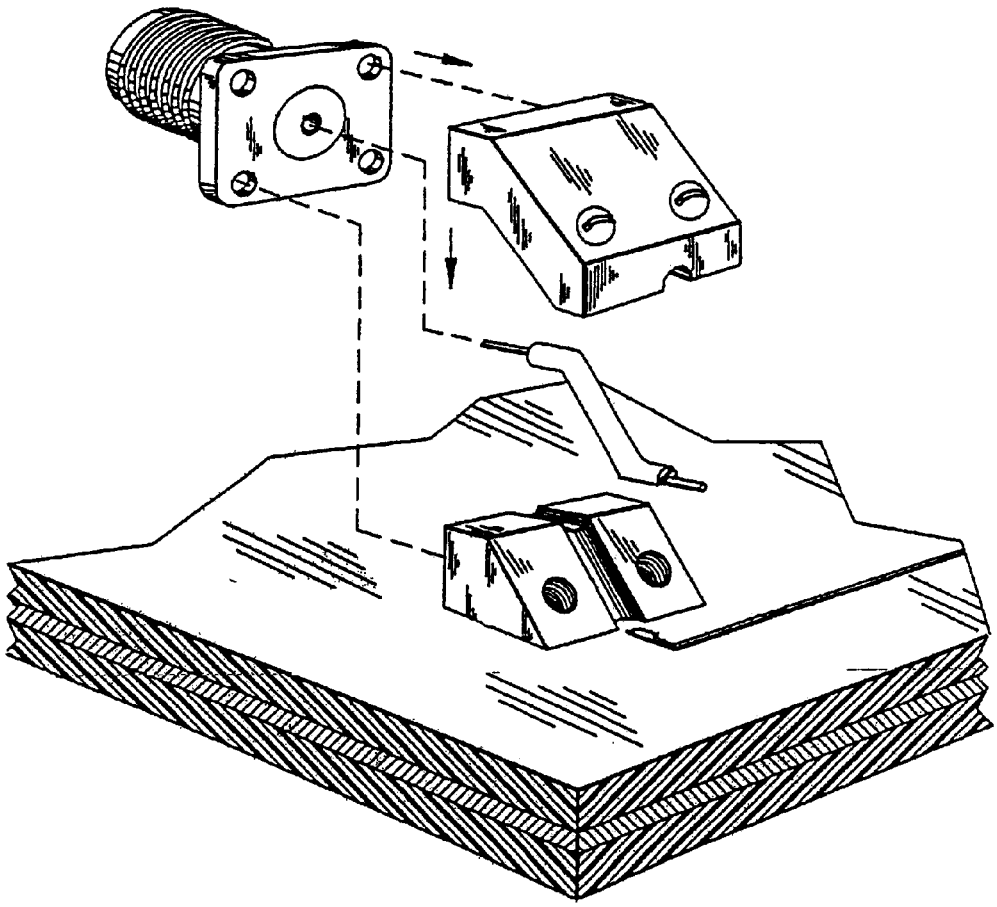
Fig. 13 Prior Art
FIG. 13 is a perspective view of the connector assembly disclosed in U.S. Pat. No. 4,995,815.
Figure 14:
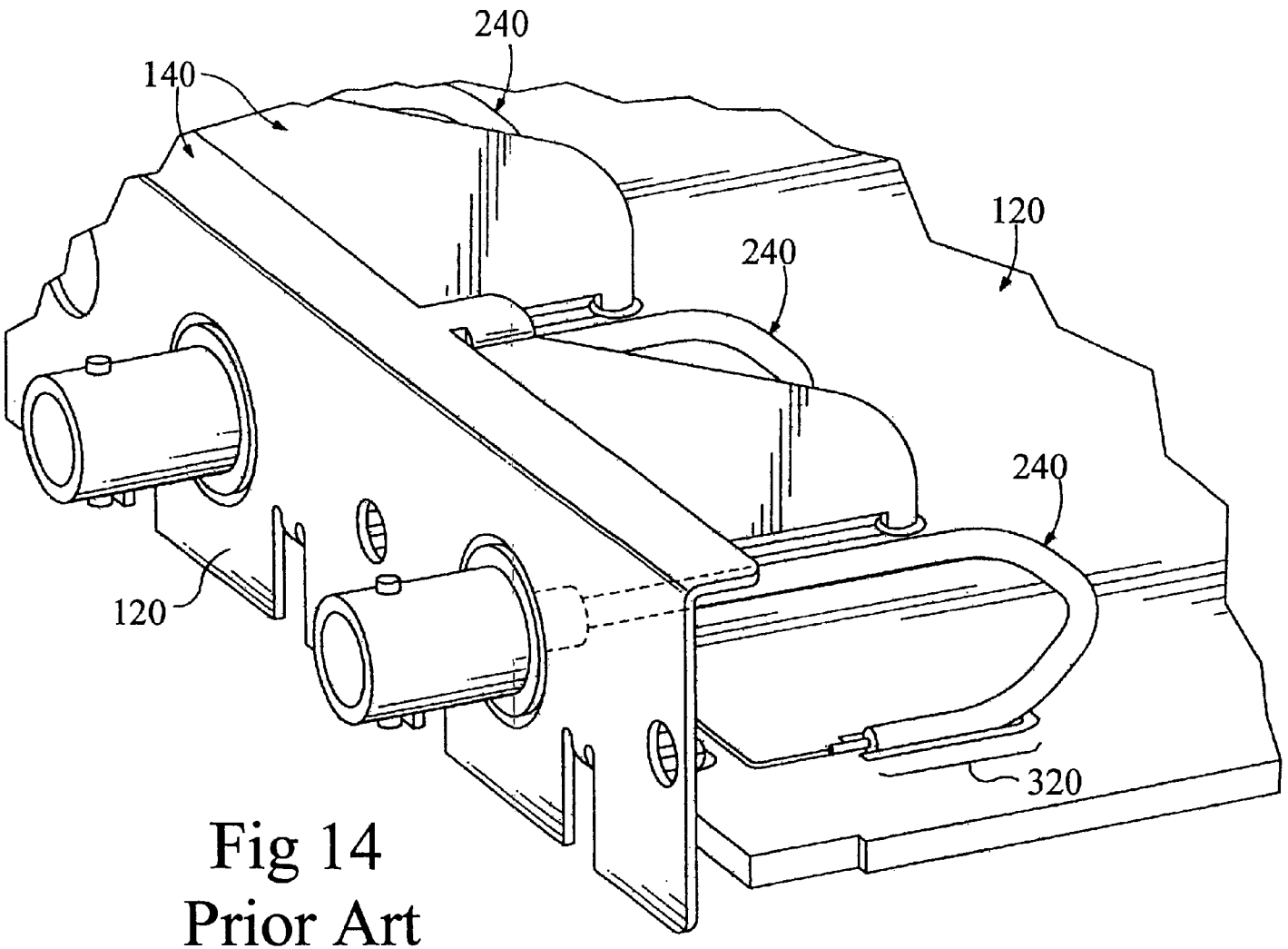
Fig 14 Prior Art
FIG. 14 is a perspective view of the connector assembly disclosed in U.S. Pat. No. 6,007,347.

FIG. 10 shows another embodiment of the present invention, wherein a single connector body 20 is formed with an integral base member 50, which allows the connector body 20 to be connected directly to circuit board 3 at any position. The connector body 20 shown in FIG. 10 has the same internal structure as the connector bodies 20 described above. The only significant difference is that the retaining member 36 formed at the second end 24 of the connector bodies shown in FIGS. 1–7 is replaced with base member 50 to provide direct connection of the single connector 20 to circuit board 3 using screws or the like.

Figure 11:
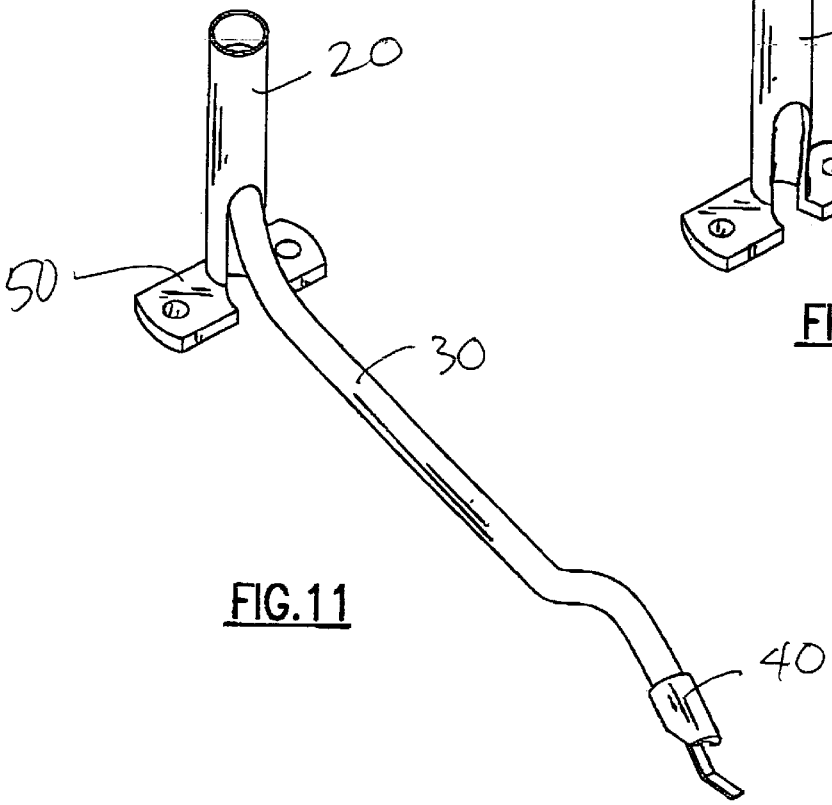
FIG. 11 is a perspective view of a connector assembly including the connector body shown in FIG. 10.

FIG. 11 shows that the single connector body 20 shown in FIG. 10 can be operatively connected with a coaxial cable segment 30 in the same manner as described above. The terminal end of coaxial cable segment 30 is also terminated by port 40 in the same manner described above.

The embodiment shown in FIGS. 10 and 11 is useful in certain applications that require only a few connections between a circuit board and exterior coaxial cables. As with the connector bodies described in the context of FIGS. 1–7, the center contact 28 in the connector body shown in FIGS. 10 and 11 is releasably positioned with the central bore 29 of insulator 27, so as to provide easy replacement in the manner described above with respect to FIGS. 6 and 7.

While the present invention has been particularly shown and described with reference to the preferred mode as illustrated in the drawings, it will be understood by one skilled in the art that various changes in detail may be effected therein without departing from the spirit and scope of the invention as defined by the claims. For example, while the drawings show flange 36 on connector body 20 engaging recess 37 of housing 10, an inwardly extending flange could be formed as part of upper wall 11 of housing 10 to engage an upper portion of each connector body 20 and releasably retain connector bodies 20 within housing 10.

Additionally, while the drawings show the distal end of each coaxial cable segment terminated by a port 40, the distal ends could be soldered directly to circuit board 3 or terminated with a cable connector for attachment to a standard feed-through port soldered to circuit board 3.

What is claimed:

1. A connector assembly for coupling a plurality of coaxial cables to a substrate, comprising:

a housing adapted to be removably attached to an area of a substrate, said housing having a first wall with an array of holes formed therethrough;

a plurality of connector bodies releasably retained within said housing in substantial alignment with said array of holes, each connector body comprising a bore extending therethrough, an insulator fixed within said bore, and a center contact releasably positioned within a central bore formed in said insulator; and a coaxial cable segment operatively connected to each of said connector bodies, each coaxial cable segment comprising a center conductor fixed to said center contact and an outer shielding conductor fixed to said connector body, each of said coaxial cable segments extending outwardly from said housing and having a distal end adapted to be connected to another area of the substrate.

2. The connector assembly of claim 1, wherein the entirety of each said connector body is positioned within said housing.

3. The connector assembly of claim 1, wherein at least two of said coaxial cable segments have lengths that differ from one another.

4. The connector assembly of claim 1, wherein said connector body includes a first end positioned proximate said first wall of said housing and said insulator is fixed within said bore of said connector body at a position proximate said first end thereof.

5. The connector assembly of claim 1, wherein said connector body has a first end positioned proximate said first wall of said housing and an opposed second end, and is substantially cylindrical having a sidewall defining said bore, said connector body further comprising a slot extending through said sidewall proximate said second end thereof, wherein said coaxial cable segment extends through said slot.

6. The connector assembly of claim 5, wherein said housing further comprises at least one sidewall and a plurality of slots formed therethrough in substantial alignment with said slots in said connector bodies.

7. The connector assembly of claim 4, wherein said connector body includes a second end opposite said first end thereof and further comprises a retaining member at said second end thereof, which engages a portion of said housing to releasably retain said connector body within said housing.

8. The connector assembly of claim 7, wherein said retaining member comprises a radially extending flange and said portion of said housing includes an annular recess that is substantially complementary in shape to and receives said flange.

9. The connector assembly of claim 1, further comprising a securing mechanism for removably attaching said housing to the substrate.

10. The connector assembly of claim 1, wherein said bore of said connector body includes a first section having a first diameter and a second section having a second diameter smaller than said first diameter, said insulator being fixed within said first section and said shielding conductor of said coaxial cable segment being fixed within said second section.

11. The connector assembly of claim 10, wherein said connector body includes a first end positioned proximate said first wall of said housing and an opposed second end, and said first section is positioned proximate said first end of said connector body and said second section is positioned toward said second end of said connector body.

12. The connector assembly of claim 1, further comprising a port fixed to said distal end of said coaxial cable segment to mechanically and electrically terminate said center conductor and said shielding conductor to the substrate.

13. The connector assembly of claim 12, wherein said port has a first end, an opposed second end, and a bore extending therethrough from said first end to said second end.

14. The connector assembly of claim 13, wherein said bore of said port includes a first section having a first diameter positioned proximate said first end thereof, and a second section having a second diameter positioned proximate said second end thereof, wherein said shielding conductor of said coaxial cable segment is fixed to said first section and said center conductor extends through said second section.

15. The connector assembly of claim 13, wherein a portion of said second end is inclined with respect to a center axis of said port, said portion being adapted to engage the substrate.

16. The connector assembly of claim 15, further comprising positioning members extending from said portion of said second end of said port.

17. A circuit board apparatus comprising:

a circuit board having at least one functional device positioned on a first area thereof;

a connector assembly positioned on a second area of said circuit board, said connector assembly comprising (i) a housing removably attached to a second area of said circuit board distal from said first area, said housing comprising a first wall with an array of holes formed therethrough, (ii) a plurality of connector bodies releasably retained within said housing in substantial alignment with said array of holes, each connector body comprising a bore extending therethrough, an insulator fixed within said bore, and a center contact releasably positioned within a central bore formed in said insulator, and (iii) a coaxial cable segment operatively connected to each of said connector bodies, each coaxial cable segment comprising a center conductor fixed to said center contact and an outer shielding conductor fixed to said connector body, each of said coaxial cable segments extending outwardly from said housing and having a distal end; and a port fixed to said distal end of each coaxial cable segment to mechanically and electrically terminate said center conductor and said shielding conductor to said circuit board.

18. The circuit board apparatus of claim 17, wherein the entirety of each said connector body is positioned within said housing.

19. The circuit board apparatus of claim 17, wherein at least two of said coaxial cable segments have lengths that differ from one another.

20. The circuit board apparatus of claim 17, wherein said connector body includes a first end positioned proximate said first wall of said housing and said insulator is fixed within said bore of said connector body at a position proximate said first end thereof.

21. The circuit board apparatus of claim 17, wherein said connector body has a first end positioned proximate said first wall of said housing and an opposed second end, and is substantially cylindrical having a sidewall defining said bore, said connector body further comprising a slot extending through said sidewall proximate said second end thereof, wherein said coaxial cable segment extends through said slot.

22. The circuit board apparatus of claim 21, wherein said housing further comprises at least one sidewall and a plurality of slots formed therethrough in substantial alignment with said slots in said connector bodies.

23. The circuit board apparatus of claim 20, wherein said connector body includes a second end opposite said first end thereof and further comprises a retaining member at said second end thereof, which engages a portion of said housing to releasably retain said connector body within said housing.

24. The circuit board apparatus of claim 23, wherein said retaining member comprises a radially extending flange and said portion of said housing includes an annular recess that is substantially complementary in shape to and receives said flange.

25. The circuit board apparatus of claim 17, further comprising a securing mechanism for removably attaching said housing to said circuit board.

26. The circuit board apparatus of claim 17, wherein said bore of said connector body includes a first section having a first diameter and a second section having a second diameter smaller than said first diameter, said insulator being fixed within said first section and said shielding conductor of said coaxial cable segment being fixed within said second section.

27. The circuit board apparatus of claim 26, wherein said connector body includes a first end positioned proximate said first wall of said housing and an opposed second end, and said first section is positioned proximate said first end of said connector body and said second section is positioned toward said second end of said connector body.

28. The circuit board apparatus of claim 17, wherein said port has a first end, an opposed second end, and a bore extending therethrough from said first end to said second end.

29. The circuit board apparatus of claim 28, wherein said bore of said port includes a first section having a first diameter positioned proximate said first end thereof, and a second section having a second diameter positioned proximate said second end thereof, wherein said shielding conductor of said coaxial cable segment is fixed to said first section and said center conductor extends through said second section.

30. The circuit board apparatus of claim 28, wherein a portion of said second end is inclined with respect to a center axis of said port, said portion being adapted to engage said circuit board.

31. The circuit board apparatus of claim 30, further comprising positioning members extending from said portion of said second end of said port.

32. A circuit board apparatus comprising:

a circuit board having at least one functional device positioned on a first area thereof;

a connector removably fastened on a second area of said circuit board, said connector comprising:

a substantially cylindrical connector body having a first end, an opposed second end, a sidewall defining a bore extending from said first end to said second end, and a slot extending through said sidewall proximate said second end thereof, an insulator fixed within said bore, and a center contact releasably positioned within a central bore formed in said insulator;

a coaxial cable segment operatively connected to said connector body, said coaxial cable segment comprising a center conductor fixed to said center contact and an outer shielding conductor fixed to said connector body, said coaxial cable segment extending outwardly from said connector body through said slot and having a distal end; and a port fixed to said distal end of said coaxial cable segment to mechanically and electrically terminate said center conductor and said shielding conductor to said circuit board.

33. The circuit board apparatus of claim 32, wherein said insulator is fixed within said bore of said connector body at a position proximate said first end thereof.

34. The circuit board apparatus of claim 32, wherein said connector body further comprises a retaining member at said second end thereof, for removably fastening said connector to said second area of said circuit board.

35. The circuit board apparatus of claim 32, wherein said bore of said connector body includes a first section having a first diameter and a second section having a second diameter smaller than said first diameter, said insulator being fixed within said first section and said shielding conductor of said coaxial cable segment being fixed within said second section.

36. The circuit board apparatus of claim 35, wherein said first section is positioned proximate said first end of said connector body and said second section is positioned toward said second end of said connector body.

37. The circuit board apparatus of claim 32, wherein said port has a first end, an opposed second end, and a bore extending therethrough from said first end to said second end.

38. The circuit board apparatus of claim 37, wherein said bore of said port includes a first section having a first diameter positioned proximate said first end thereof, and a second section having a second diameter positioned proximate said second end thereof, wherein said shielding conductor of said coaxial cable segment is fixed to said first section and said center conductor extends through said second section.

39. The circuit board apparatus of claim 37, wherein a portion of said second end is inclined with respect to a center axis of said port, said portion being adapted to engage said circuit board.

40. The circuit board apparatus of claim 39, further comprising positioning members extending from said portion of said second end of said port.

* * * * *